US005465028A

United States Patent [19]

Antonis et al.

[11] Patent Number: 5,465,028

[45] Date of Patent: Nov. 7, 1995

[54] ILLUMINATION UNIT, AND ELECTRODELESS LOW-PRESSURE DISCHARGE LAMP AND COIL SUITABLE FOR USE THEREIN

[75] Inventors: Petrus H. Antonis, Eindhoven, Netherlands; Jacob Schlejen, Morgantown, W. Va.; Leonardus U. E. Konings, Eindhoven, Netherlands

[73] Assignee: U.S. Philips Corporation, New York, N.Y.

[21] Appl. No.: 138,946

[22] Filed: Oct. 18, 1993

[30] Foreign Application Priority Data

Oct. 21, 1992 [EP] European Pat. Off. ..... 92203222

[51] Int. Cl.[6] ..... H05B 41/16

[52] U.S. Cl. ..... 315/248; 315/276; 315/278; 315/39; 313/493

[58] Field of Search ..... 315/248, 276, 315/278, 39, 85, 242, 344; 313/161, 493

[56] References Cited

U.S. PATENT DOCUMENTS

| | | | |
|---|---|---|---|
| 3,748,510 | 7/1973 | McNeal | 310/71 |
| 4,562,384 | 12/1985 | Owen | 315/276 |
| 4,710,678 | 12/1987 | Houkes et al. | 315/248 X |
| 4,727,295 | 2/1988 | Postma et al. | 315/248 |
| 5,291,091 | 3/1994 | Eggink et al. | 313/161 |

FOREIGN PATENT DOCUMENTS 0162504 11/1985 European Pat. Off. .

*Primary Examiner*—Benny Lee
*Assistant Examiner*—Haissa Philogene
*Attorney, Agent, or Firm*—Brian J. Wieghaus

[57] ABSTRACT

An illumination unit of the invention comprises an electrodeless low-pressure discharge-lamp (10) and a high-frequency power supply (50). The lamp (10) is provided with a gastight closed discharge vessel (20) with an ionizable fill (21). The lamp (10) further is provided with a coil (30) with turns (31,32) of a primary and a secondary winding (33,34). The power supply unit 50 is provided with input terminals (51*a*,51*b*) and is further provided with a first output terminal (52*a*), electrically neutral with respect to mass, that is connected to a first end (36*a*) of the primary winding (33) and with a further output terminal (52*b*) that is connected to a second end (36*b*) of the primary winding (33). During nominal operation of the lamp (10) the primary winding (33) excites a high-frequency magnetic field that maintains an electrical discharge in the discharge vessel (20) and that induces in the secondary winding (34) a potential drop in the direction of a first, with respect to the mass electrically neutral end (37*a*), to a second free end (37*b*) that varies in an opposite sense to the potential drop from the first to second end (36*a*, 36*b*) in the first winding (33). In a first end portion (39*a*) of the coil (30) that comprises half of the turns of the coil (30), the relative amount of turns (31) of the primary winding (33) is at least 3/2 times as large as the relative amount of turns (32) of the secondary winding (34). The measure of the invention improves the ignition speed of the lamp.

23 Claims, 2 Drawing Sheets

ILLUMINATION UNIT, AND ELECTRODELESS LOW-PRESSURE DISCHARGE LAMP AND COIL SUITABLE FOR USE THEREIN

CROSS REFERENCE TO RELATED APPLICATION

This application relates to U.S. application Ser. No. 08/138,948 of Petrus H. Antonis et al, filed simultaneously herewith.

BACKGROUND OF THE INVENTION

The invention relates to an illumination unit comprising an electrodeless low-pressure discharge lamp and a high-frequency electric supply device, which lamp is provided with a discharge vessel sealed in a gastight manner and containing an ionizable filling and with a coil comprising turns of a primary winding and of a secondary winding, which supply device is provided with input terminals, with an output terminal which is electrically neutral with respect to ground and which is connected to a first end of the primary winding, and with a further output terminal which is connected to a second end of the primary winding, a high-frequency magnetic field being generated by the primary winding in a nominal operating condition, which field maintains an electric discharge in the discharge vessel and induces a potential gradient in the secondary winding in a direction from a first end which is electrically neutral with respect to ground to a second, free end of the secondary winding, which gradient is oppositely directed to the potential gradient from the first to the second end in the primary winding.

The invention also relates to an electrodeless low-pressure discharge lamp suitable for use in the illumination unit.

The invention further relates to a coil suitable for use in the illumination unit.

Such an illumination unit is known from EP 0.162.504 A1. The discharge vessel of the lamp of this illumination unit has a luminescent layer at the inside and is provided with a filling comprising mercury. The coil, which has 13 turns in a primary winding over a length of 25 mm and 14.5 turns in a secondary winding over a length of 30 mm, is provided around a core of soft magnetic material of 50 mm length.

A potential distribution across the coil resulting from the potential gradient occurring in each of the windings causes an electric field which is of importance for lamp ignition.

The asymmetrical supply device used in the illumination unit, where one of the terminals has a potential which at least substantially corresponds to ground and the other has a potential different therefrom, may be comparatively simple compared with a symmetrical supply device, i.e. a supply device with connection terminals which have mutually opposite potentials with respect to ground.

Although an asymmetrical supply device is used in the known illumination unit, the presence of the secondary winding results in a potential distribution across the coil which is at least substantially balanced relative to ground, so that the average potential over the coil surface is approximately equal to that of ground. Interference effects in the mains and in the environment have been limited to an acceptable level thereby.

A disadvantage of the known illumination unit is that the lamp ignites with comparatively great difficulty compared with a lamp of an illumination unit in which the coil has no secondary winding. This has the result that the ignition circuit is heavily loaded during a prolonged period, which may lead to a reduced operating life. It is true that the ignition time can be shortened by offering a higher ignition voltage, but this requires the use of comparatively expensive components.

SUMMARY OF THE INVENTION

It is an object of the invention to provide an illumination unit of the kind described in the opening paragraph in which the lamp ignites comparatively easily and which nevertheless causes comparatively little interference. A further object of the invention is to provide an electrodeless low-pressure discharge lamp suitable for use in such an illumination unit. A yet further object of the invention is to provide a coil suitable for use in such an illumination unit.

According to the invention, the illumination unit is for this purpose characterized in that the relative number of turns of the primary winding is at least 3/2 times the relative number of turns of the secondary winding in a first end portion of the coil which comprises half the number of turns of the coil. The term "relative number of turns" in the present description is understood to mean the number of turns of a winding in the first end portion divided by the total number of turns of this winding. For an identical ignition voltage applied to the first turn, the coil of the illumination unit according to the invention has a resulting potential distribution which generates a comparatively strong electric field compared with that of a coil without the measure according to the invention but similar in all other respects. As a result, the lamp of the illumination unit ignites more quickly. The coil of the illumination unit according to the invention may be provided, for example, with a first end portion having turns exclusively of the primary winding and with a second end portion having turns exclusively of the secondary winding.

Nevertheless, also when an asymmetrical supply is used for the illumination unit according to the invention, the resulting potential distribution is at least substantially balanced relative to ground, so that the lamp of the illumination unit causes only little interference in the environment and the mains.

A preferred embodiment of the illumination unit according to the invention is characterized in that the primary and the secondary winding have the same winding direction. The coil can then be readily manufactured with narrow tolerances.

In an attractive implementation of this embodiment, the direction from the first end portion to a further end portion corresponds to the direction from the first to the second end of the secondary winding. This implementation has the advantage that, given a previously defined ignition voltage, the electric field generated by the potential distribution across the coil, though greater in magnitude, has approximately the same spatial distribution as that of the coil used in the known lamp.

The lamp of the illumination unit according to the invention has, for example, a coil whose primary winding and secondary winding approximately overlap one another and are wound with pitches which increase in mutually opposing directions. In an attractive embodiment of the illumination unit according to the invention which is easy to manufacture, at least one fourth of the number of turns of each winding extend to beyond the other winding. In this embodiment, for example, the turns are wound with constant pitch.

In a favourable embodiment of the illumination unit according to the invention, the coil is encapsulated in an elastic substance. The turns are then fixed in a simple manner.

BRIEF DESCRIPTION OF THE DRAWING

An embodiment of the illumination unit according to the invention is explained in more detail with reference to the drawing, in which.

DESCRIPTION OF THE PREFERRED EMBODIMENTS

Figure 1:
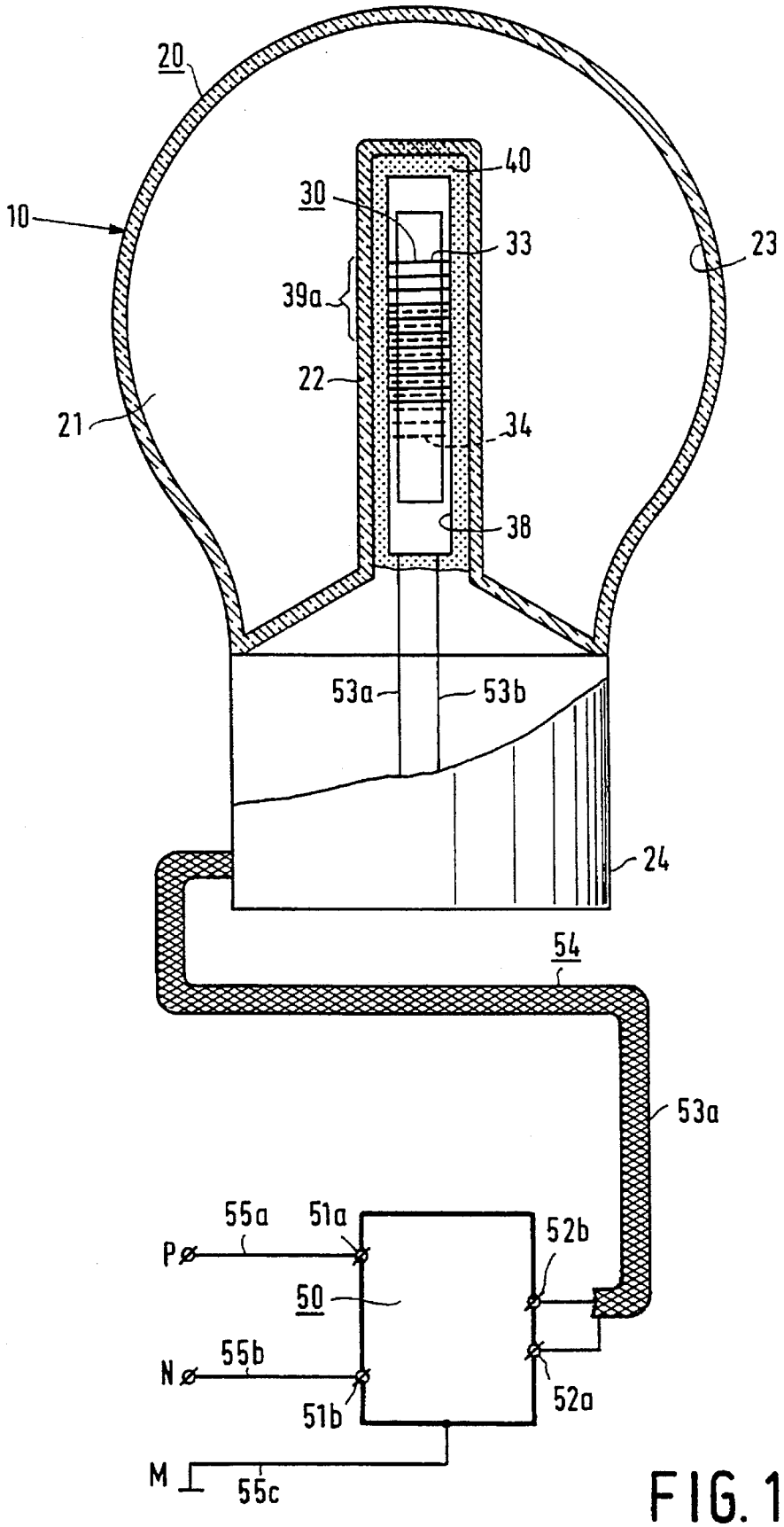
FIG. 1 shows a first embodiment in which the lamp is shown partly in side elevation and partly in longitudinal section, while the supply device is depicted diagrammatically.

A first embodiment of the illumination unit according to the invention shown in FIG. 1 comprises an electrodeless low-pressure discharge lamp 10 and a supply device 50. The lamp 10 is provided with a pear-shaped discharge vessel 20 which is sealed in a gastight manner and has an ionizable filling 21 comprising 6 mg mercury and 180 mg of an amalgam of bismuth and indium in a weight ratio of 67:33. The filling 21 in addition comprises argon at a filling pressure of 33 Pa. The lamp 10 is also provided with a coil 30 having a length $L_s$ of 55 mm which is accommodated in a recess 22 of the discharge vessel.

Figure 2:
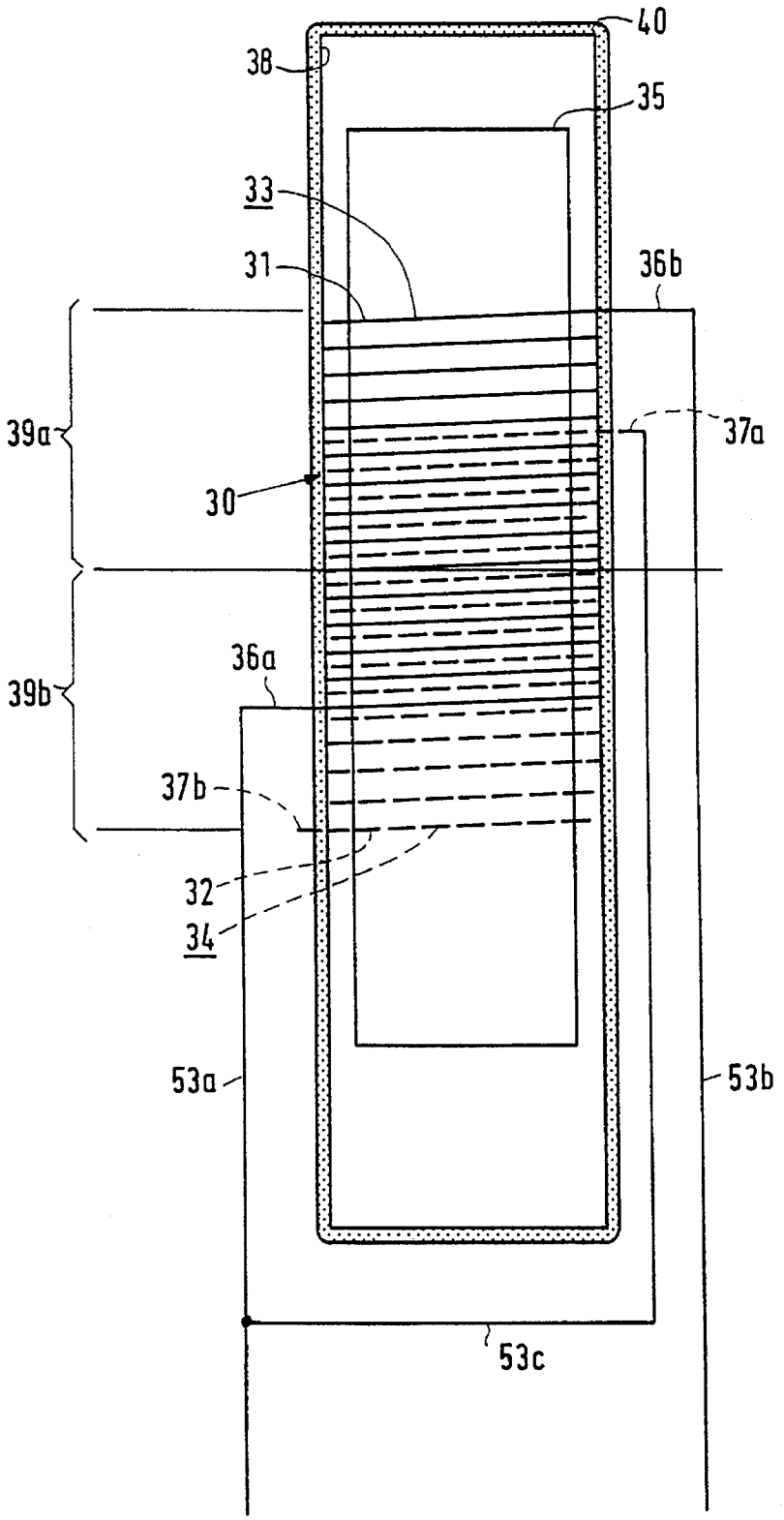
FIG. 2 shows components of the lamp of FIG. 1 in side elevation.

The coil 30, shown in more detail in FIG. 2, is provided with a total of 14.5 turns 31 of a primary winding 33 and 14.5 turns 32 of a secondary winding 34 around a synthetic-resin coil former 38. In an alternative embodiment, the secondary winding has, for example, one or one and a half turn more than the primary winding. For greater clarity, the coil former 38 in FIG. 2 is depicted as transparent, and portions of the turns 31, 32 extending behind the coil former 38 are not shown. The primary and the secondary winding 33, 34 have the same winding direction. In this case the two windings 33, 34 are wound clockwise. The coil former 38 encloses a core 35 of soft magnetic material, formed by a rod of Philips 4C6 ferrite with a diameter of 12 mm and a length of 50 mm. In an alternative embodiment, for example, the coil has an air core, or the core is made of, for example, a synthetic resin or a ceramic material. The primary and the secondary winding 33, 34 are both made of insulated copper wire with a core thickness of 0.87 mm. The supply device 50 is provided with input terminals 51*a,b*. The supply device 50 is also provided with an output terminal 52*a* which is electrically neutral with respect to the mass M (ground) and which is connected to a first end 36*a* of the primary winding 33 via a current supply conductor 53*a*, and provided with a further output terminal 52*b* which is connected to a second end 36*b* of the primary winding 33 via a current supply conductor 53*b*. In a nominal operating condition, the primary winding 33 generates a high-frequency magnetic field which maintains an electric discharge in the discharge vessel 20. A potential gradient is induced in the secondary winding 34 in a direction away from a first end 37*a* which is electrically neutral with respect to ground, i.e. at ground portent, to a second free end 37*b*, which gradient is oppositely directed to the potential gradient from the first to the second end 36*a,b* in the primary winding 33. The potential averaged over the surface of the coil 30 is approximately equal to ground potential. The first end 37*a* of the secondary winding 34 is electrically neutral because it is connected to the first end 36*a* of the primary winding via a current conductor 53*c*. Alternatively, the first end 37*a* may be connected, for example, to ground.

In a first end portion 39*a* of the coil 30 comprising half the number of turns of the coil 30, the relative number of turns 31 of the primary winding 33 is more than 3/2 times the relative number of turns 32 of the secondary winding 34. In this case, the first end portion comprises 9.5 of the 14.5 turns 31 of the primary winding 33, and 5 of the 14.5 turns 32 of the secondary winding 34. The relative number of turns 31 of the primary winding 33 in the first end portion 39*a* of the coil 30, accordingly, is 0.62, which is approximately 1.8 times more than the relative number (0.34) of turns 32 of the secondary winding 34 in the first end portion 39*a*.

The direction from the first end portion 39*a* to a further end portion 39*b* corresponds to the direction from the first end 37*a* to the second end 37*b* of the secondary winding 34.

In the embodiment shown, more than one fourth of the number of turns 31, 32 of each winding 33, 34 extend to beyond the other winding 34, 33. In this case, 4.5 of the 14.5 turns 31 of the primary winding 33 extend to beyond the first end 37*a* of the secondary winding 34, and 4.5 of the 14.5 turns 32 of the secondary winding 34 extend to beyond the first end 36*a* of the primary winding 33. The coil 30 is encapsulated in an elastic substance 40 (shown as transparent in the Figure). Q3-3600 silicone resin from Dow Corning was used in this case.

The discharge vessel 20 is provided at its inner surface with a layer 23 of green-luminescing terbium-activated cerium-magnesium aluminate and red-luminescing yttrium oxide activated by trivalent europium. In an alternative embodiment of the illumination unit according to the invention, such a layer is absent and the discharge vessel has a filling comprising an amalgam of sodium and mercury. The discharge vessel 20 is fixed on a carrier 24 of synthetic resin into whose interior a coaxial cable 54 is passed, which cable is connected to the supply device 50 and whose current supply conductors 53*a,b* form a sheath and a core, respectively. The supply device 50 is connected to connection terminals P, N of the mains by means of current conductors 55*a,b*. The supply device has a housing 56 which is connected to the mass M via an earthing line 55*c*. In a modified embodiment, the carrier is provided with a lamp cap at an end remote from the discharge vessel, for example, an Edison lamp cap in which lamp cap contacts are connected to a supply device incorporated in the carrier.

The supply device of the embodiment of the illumination unit according to the invention described with reference to the Figures has a frequency of 2.65 MHz. The lamp consumes a power of 70 W and has a light output of 5500 lm during nominal operation. The ignition time of the lamp in this illumination unit was on average twice as short as that of a lamp in an illumination unit not according to the invention with a coil of the same length whose primary and secondary windings lie against one another over substantially the entire length, all other circumstances being equal. The influence on the mains and on the environment was found to be of the same order of magnitude for both illumination units.

We claim:

1. An illumination unit, comprising:

an electrodeless low-pressure discharge lamp comprising a discharge vessel sealed in a gastight manner and containing an ionizable filling and a coil for generating an electric field within said discharge vessel, said coil comprising a primary winding having respective turns and a secondary winding having respective turns; and a supply device comprising input terminals, an output terminal which is electrically neutral with respect to ground and which is connected to a first end of the primary winding, and a further output terminal which is connected to a second end of the primary winding, a high-frequency magnetic field being generated by the primary winding in a nominal operating condition, which field maintains an electric discharge in the discharge vessel and induces a potential gradient in the secondary winding in a direction from a first end which is electrically neutral with respect to ground to a second, free end of the secondary winding, which gradient is oppositely directed to the potential gradient from the first to the second end in the primary winding, and wherein the relative number of turns of the primary winding is at least 3/2 times the relative number of turns of the secondary winding in a first end portion of the coil which comprises half the number of turns of the coil.

2. An illumination unit as claimed in claim 1, characterized in that the primary and the secondary winding have the same winding direction.

3. An illumination unit as claimed in claim 2, characterized in that the direction from the first end portion to a further end portion of said coil corresponds to the direction from the first to the second end of the secondary winding.

4. An illumination unit as claimed in claim 3, characterized in that at least one fourth of the number of turns of each winding extend to beyond the other winding, respectively.

5. An illumination unit as claimed in claim 4, characterized in that the coil is encapsulated in an elastic substance.

6. An electrodeless low-pressure discharge lamp having a discharge vessel sealed in a gastight manner and containing an ionizable filling and a coil comprising turns of a primary winding and of a secondary winding, a pair of connection terminals for connection to a source of high frequency electrical signals, one of said connection terminals being connected to a first end of the primary winding and the other connection terminal being connected to a second end of the primary winding, a high-frequency magnetic field being generated by the primary winding in a nominal operating condition, which field maintains an electric discharge in the discharge vessel and induces a potential gradient in the secondary winding in a direction from a first end which is electrically neutral with respect to ground to a second, free end of the secondary winding, which gradient is oppositely attracted to the potential gradient from the first to the second end in the primary winding, characterized in that:

the relative number of turns of the primary winding is at least 3/2 times the relative number of turns of the secondary winding in a first end portion of the coil which comprises half the number of turns of the coil.

7. A coil for an electrodeless low-pressure mercury vapor discharge lamp, said coil comprising turns of a primary winding and of a secondary winding, characterized in that the relative number of turns of the primary winding is at least 3/2 times the relative number of turns of the secondary winding in a first end portion of the coil which comprises half the number of turns of the coil.

8. An illumination unit as claimed in claim 3, characterized in that the coil is encapsulated in an elastic substance.

9. An illumination unit as claimed in claim 2, characterized in that the coil is encapsulated in an elastic substance.

10. An illumination unit as claimed in claim 1, characterized in that the coil is encapsulated in an elastic substance.

11. An illumination unit as claimed in claim 3, characterized in that at least one fourth of the number of turns on each winding extend to beyond the other winding.

12. An illumination unit as claimed in claim 11, characterized in that the coil is encapsulated in an elastic substance.

13. An illumination unit as claimed in claim 2, characterized in that the coil is encapsulated in an elastic substance.

14. An illumination unit as claimed in claim 13, characterized in that the coil is encapsulated in an elastic substance.

15. An illumination unit as claimed in claim 1, characterized in that at least one fourth of the number of turns of each winding extend to beyond the other winding.

16. An illumination unit as claimed in claim 15, characterized in that the coil is encapsulated in an elastic substance.

17. An electrodeless low-pressure discharge lamp as claimed in claim 6, characterized in that the primary and the secondary winding have the same winding direction.

18. An electrodeless low-pressure discharge lamp as claimed in claim 17, characterized in that the direction from the first end portion to a further end portion corresponds to the direction from the first to the second end of the secondary winding.

19. An electrodeless low-pressure discharge lamp as claimed in claim 6, characterized in that at least one fourth of the number of turns of each winding extend to beyond the other winding.

20. An electrodeless low-pressure discharge lamp as claimed in claim 6, characterized in that the coil is encapsulated in an elastic substance.

21. A coil as claimed in claim 7, characterized in that the primary and the secondary winding have the same winding direction.

22. A coil as claimed in claim 21, characterized in that the direction from the first end portion to a further end portion corresponds to the direction from the first to the second end of the secondary winding.

23. A coil as claimed in claim 7, characterized in that at least one fourth of the number of turns of each winding extend to beyond the other winding.

* * * * *